US008567641B2

(12) United States Patent
Kobayashi

(10) Patent No.: US 8,567,641 B2
(45) Date of Patent: Oct. 29, 2013

(54) BUSINESS CARD CASE

(75) Inventor: Shinichi Kobayashi, Kanagawa (JP)

(73) Assignee: Katoh Electrical Machinery Co., Ltd., Kanagawa (JP)

( * ) Notice: Subject to any disclaimer, the term of this patent is extended or adjusted under 35 U.S.C. 154(b) by 267 days.

(21) Appl. No.: 13/176,042

(22) Filed: Jul. 5, 2011

(65) Prior Publication Data

US 2012/0006844 A1 Jan. 12, 2012

(30) Foreign Application Priority Data

Jul. 7, 2010 (JP) ..... 2010-154826

(51) Int. Cl.
*A45C 11/18* (2006.01)

(52) U.S. Cl.
USPC ..... 221/232; 221/231; 206/39; 206/39.4; 206/39.5

(58) Field of Classification Search
USPC ..... 221/208, 226, 224, 231, 232; 206/39, 206/39.4, 39.5
See application file for complete search history.

(56) References Cited

U.S. PATENT DOCUMENTS

| | | | | | |
|---|---|---|---|---|---|
| 599,821 | A * | 3/1898 | Adkins | 221/231 |
| 2,591,855 | A * | 4/1952 | Nicholson | 221/232 |
| 3,286,823 | A * | 11/1966 | Gillespie | 206/39.5 |
| 3,308,989 | A * | 3/1967 | Alltop et al. | 221/232 |
| 4,792,058 | A * | 12/1988 | Parker | 221/232 |
| 6,412,627 | B1 * | 7/2002 | Tiscione et al. | 206/39.4 |

FOREIGN PATENT DOCUMENTS

| | | |
|---|---|---|
| JP | 62-63020 | 4/1987 |
| JP | 3108210 | 2/2005 |

* cited by examiner

*Primary Examiner* — Patrick Mackey
(74) *Attorney, Agent, or Firm* — Notaro, Michalos & Zaccaria P.C.

(57) ABSTRACT

A business card case includes a storage case, a fixing part, a lifting part, a guiding part and a discharging button. The storage case comprises a discharging opening for discharging a card, which stores cards in its interior and comprises a lower case and an upper case vertically detachable from each other. The fixing part fixes the lower case and the upper case while both the cases overlap each other. The lifting part provided on the lower case lifts up cards stored in the lower case toward the upper case. The guiding part attached to one of sides of the storage case bends at least of the ones at the top of the cards stored in the lower case. The discharging button slidably provided toward the discharging opening on the upper case includes a locking portion for locking the cards at the top.

5 Claims, 11 Drawing Sheets

BUSINESS CARD CASE

FIELD OF THE INVENTION

The present invention relates to a business card case, and more particularly, to a business card case capable of storing a plurality of business cards and discharging them one by one semi-automatically as necessary.

BACKGROUND OF THE INVENTION

Conventionally, business card cases or name card cases have been known in the art, such as those disclosed in JP Registered Utility Model Publication No. 3108210 or JP Utility Model Publication No. S62-63020. In JP Registered Utility Model Publication No. 3108210, a discharging opening of business cards or a name cards (hereinafter called cards) is provided on a storage case for storing a plurality of cards, and the stored cards are lifted upward by lifting means provided on a bottom portion of the storage case using elastic means such as a leaf spring. The card lifted upwardly can be pushed out one by one by inserting a finger into a window portion provided on a cover and by sliding the card via frictional force generated between the finger and the card. In JP Utility Model Publication No. S62-63020, a card case comprises a lifting means as well, and a discharging button member thereof is slidably mounted on a cover; The card can be discharged through a discharging opening by locking an end of a card at the top of the stack using a locking portion provided on the discharging button.

However, the business card case (hereinafter called a card case) disclosed in the above-stated JP Registered Utility Model Publication No. 3108210 of the above-mentioned prior art has a problem that it may be difficult to take the card out through the discharging opening because the card is pressed downward when the card is strongly pressed in order to push out the card stored in the storage case by finger. Another problem is that the above mentioned problem is aggravated in that elastic force of the elastic means of the lifting means is reduced, in case of less number of cards stored in the storage case.

Moreover, in the card case disclosed in the above-mentioned JP Utility Model Publication No. S62-63020, a card is to be discharged by pushing on the discharging button member, wherein the end of the card is locked by the locking portion of the discharging button member. This card case also has a problem in that because the part to be locked by the locking portion of the discharging button member is as thick as a card to be locked, the card case often fails to lock the card, so that repeated trials will be necessary. Moreover, the card case disclosed in the above-stated JP Utility Model Publication No. S62-63020 has another problem in that the discharging button should be manually returned every time a card is to be used, thus the operation is complicated.

The present invention is made to solve the above-mentioned problems. It is therefore an object of the present invention to provide a card case wherein it is possible to securely discharge a card stored in a storage case to the last one, through a discharging opening.

Moreover, an object of the present invention is to provide a card case, wherein a card is semi-automatically discharged from a storage case.

In order to achieve the above-mentioned object, the present invention is characterized in that a card case comprises a storage case having a discharging opening for discharging cards and composed of a lower case and an upper case detachable from each other, wherein the storage case can receive a plurality of stacked cards in its interior; fixing means fixing the lower case and the upper case while both the cases overlap each other; lifting means mounted on the lower case for lifting up the cards stored in the lower case toward the upper case; a guiding member mounted on one side of the storage case for bending at least the ones at the top of the stacked cards stored in the lower case; a discharging button slidably provided toward the discharging opening on the upper case, which comprises a locking portion for locking the ones at the top end of the plurality of cards; and an automatic returning means automatically returning the discharging button member from a predetermined sliding position to an initial position ;and wherein the guiding member comprises a substrate portion provided on one inside the upper case and an elastic guide body provided inside the substrate portion; and wherein an releasing recess is provided inside the substrate portion, on an upper side of the guide body.

In the inventions as described above, it is possible to allow to fix the lower case and the upper case are while both the cases overlap each other, by designing the fixing means so as to comprise fixing members openably/closably attached to both sides of the lower case, and by engaging locking protruding members provided on free end sides of the fixing members with the upper case.

Further in the present invention, the business card case according to the claim 8, wherein the lifting means are composed of elastic means being leaf springs provided on an inner bottom of the lower case.

Still Further in the present invention, the automatic returning means comprises a helical spring rotatably engaged with inner side of the top plate of the upper case at one end portion thereof, while its other end portion rotatably engaged with the guide plate provided on the discharging button member.

Further in the present invention, the guiding member mounted on an inside of one side of the storage case in contacted with business card, the guiding member having guiding portion provided on the upper inside end thereof, the guiding portion inclined or curved toward the inside, and thus those of the upper end of the business card that has been pushed up by push-up means is bent by the guide portion.

Further in the present invention, the guiding member can be so designed that a guiding portion is provided thereon, with its top side being inclined or curved toward the inner side of the storage case.

Still further in the present invention, the guiding member is characterized in that it comprises a substrate portion provided on the inner side of the upper case and an elastic guide body mounted inside the substrate portion, and that escaping releasing recess is provided inside the substrate portion on the upper portion side of the guide body.

In the invention according to claim 1 of the present invention, the cooperation of a lifting means with a guiding member allows for an increase in bent angle of the cards stored at the upper end of a storage case as compared to those stored below. Thereby, these cards are easily engaged with a locking portion of a discharging button member, and this ensures that a card is discharged from the discharging opening one by one.

When a card case is structured as in claim 2, a discharging button member could be automatically returned to an initial position after discharging operation of card(s) using the discharging button member, in addition to the above-mentioned advantage of the invention according to claim 1, thus effects can be achieved in that operability is improved.

DETAILED DESCRIPTION OF THE EMBODIMENT

Figure 1:
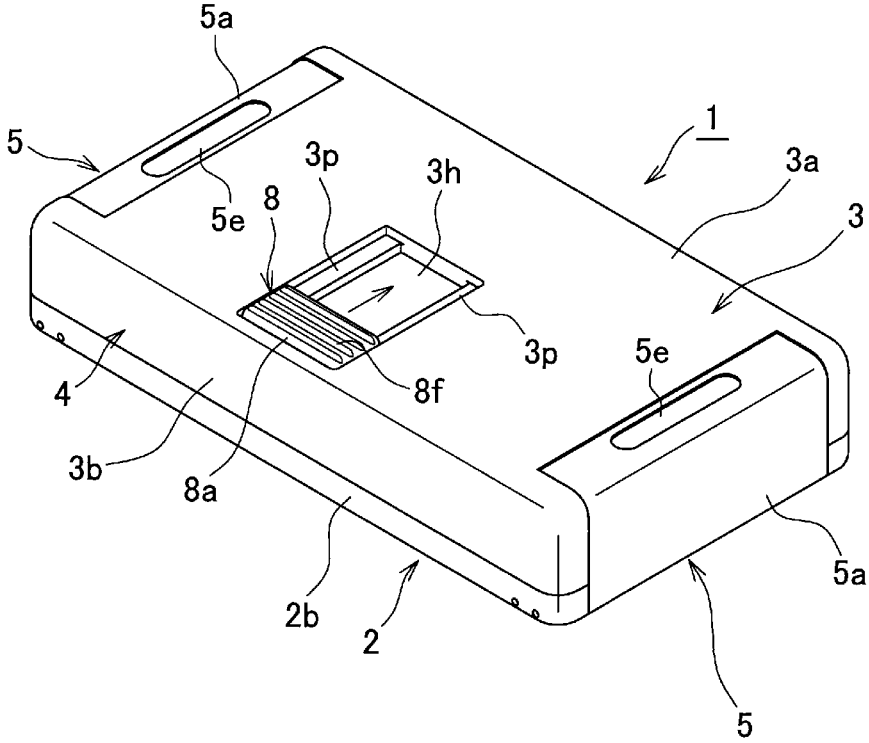
FIG. 1 is a perspective view of a card case in accordance with the present invention, as shown from one side.
Figure 2:
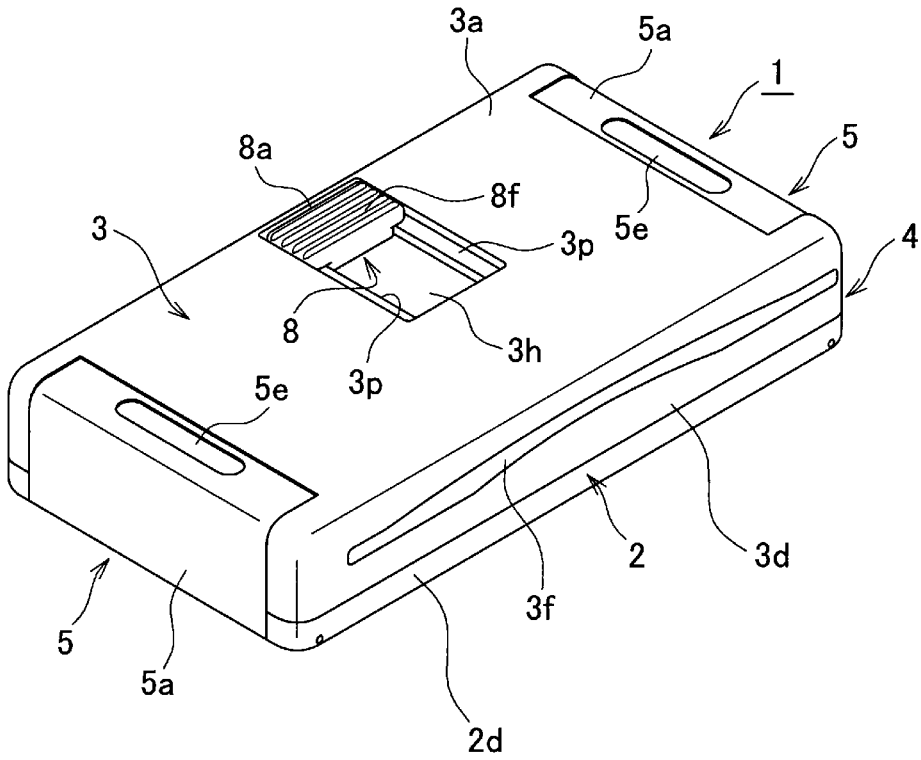
FIG. 2 is a perspective view of a card case in accordance with the present invention, as shown from other side.
Figure 3:
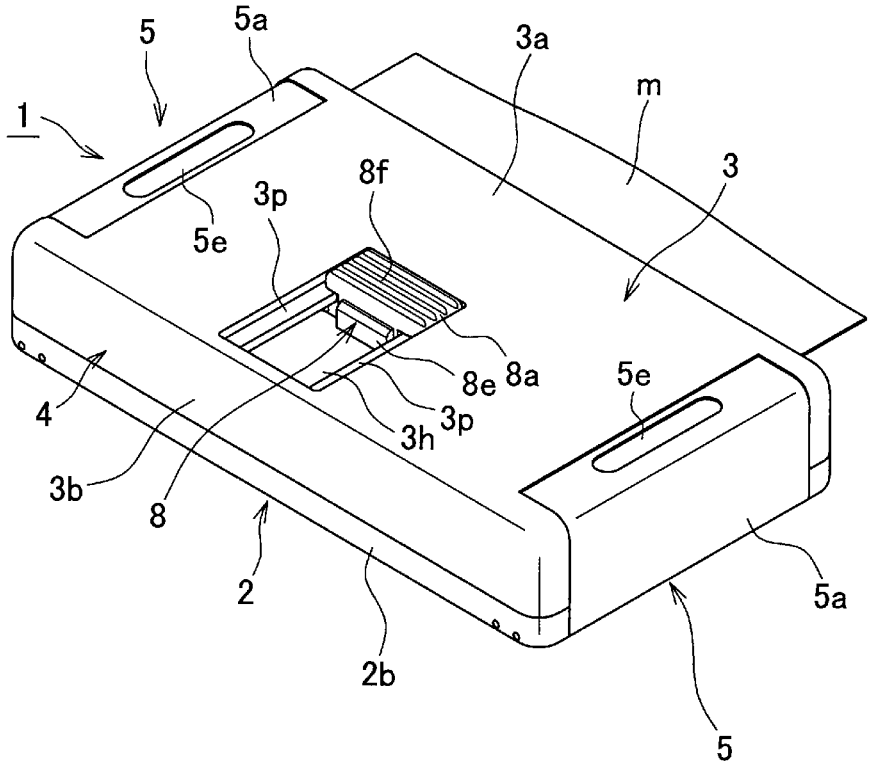
FIG. 3 is a perspective view of a card case, with a card being discharged from the state shown in FIG. 1.

Embodiments of the present invention are described hereinafter with reference to the accompanying drawings.

Embodiment 1

FIGS. 1 to 10 show a first embodiment of the present invention. According to the drawings, a business card case or a name card case (hereinafter called a card case) 1 according to this embodiment 1 comprises a storage case 4 for storing a plurality of business cards or name cards (hereinafter called cards) M in its interior, which is composed of a lower case 2 and an upper case 3 which are vertically detachable from each other; fixing means 5 for fixing the upper case 3 and the lower case 2 while both the cases overlap each other; lifting means 6 which are composed of elastic means being leaf springs 6*a*, 6*a*, 6*b*, 6*b* provided on an inner bottom of the lower case 2; a guiding member 7 for bending cards stored inside the storage case 4; a discharging button member 8 slidably provided on the upper case 3; and an automatic returning means 9 for automatically returning the discharging button member 8 to an initial position. A slightly bent discharging opening 3*f* is provided in one side of the upper case 3.

Figure 5:
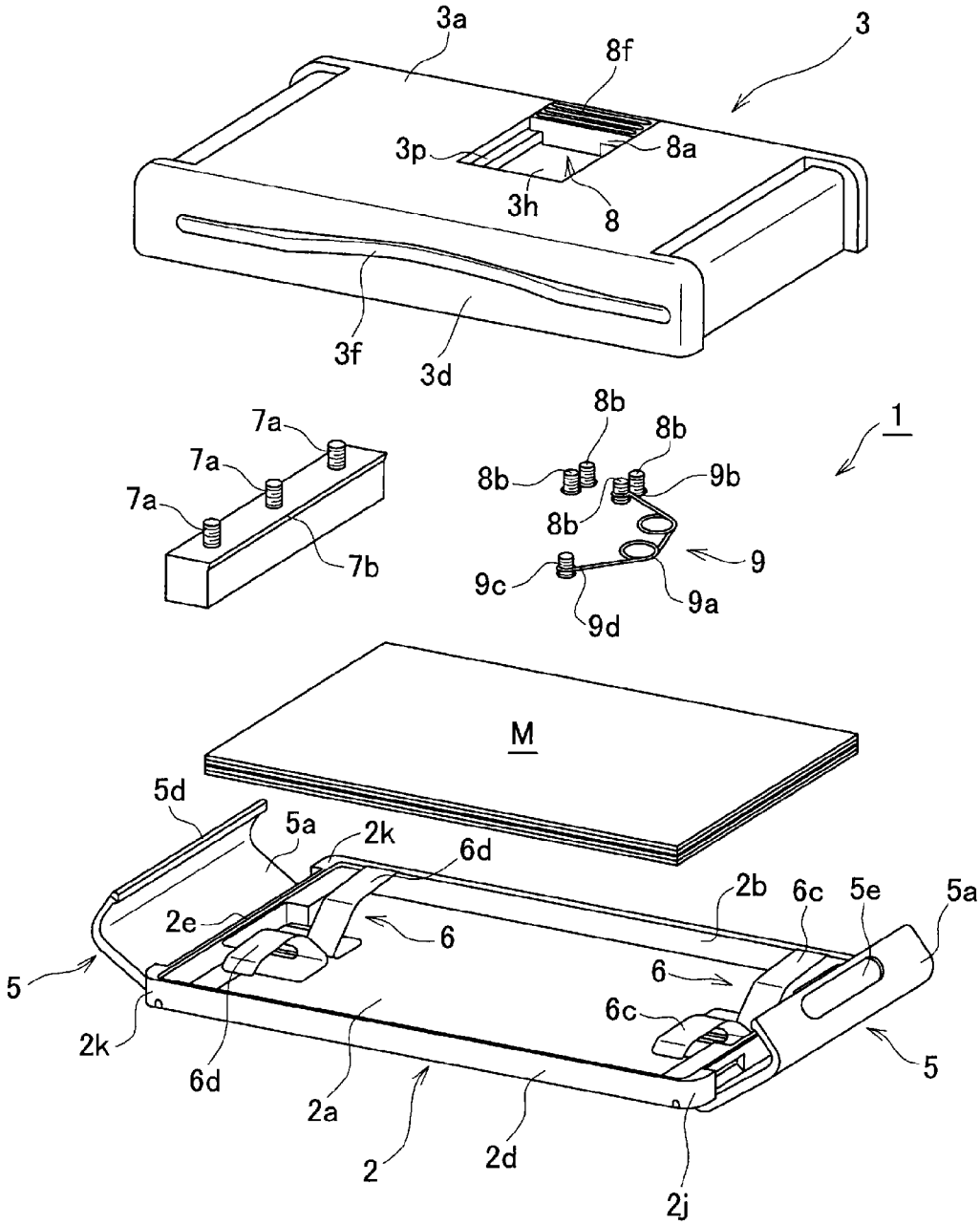
FIG. 5 is a partial exploded view of a business card case in accordance with the present invention.
Figure 6:
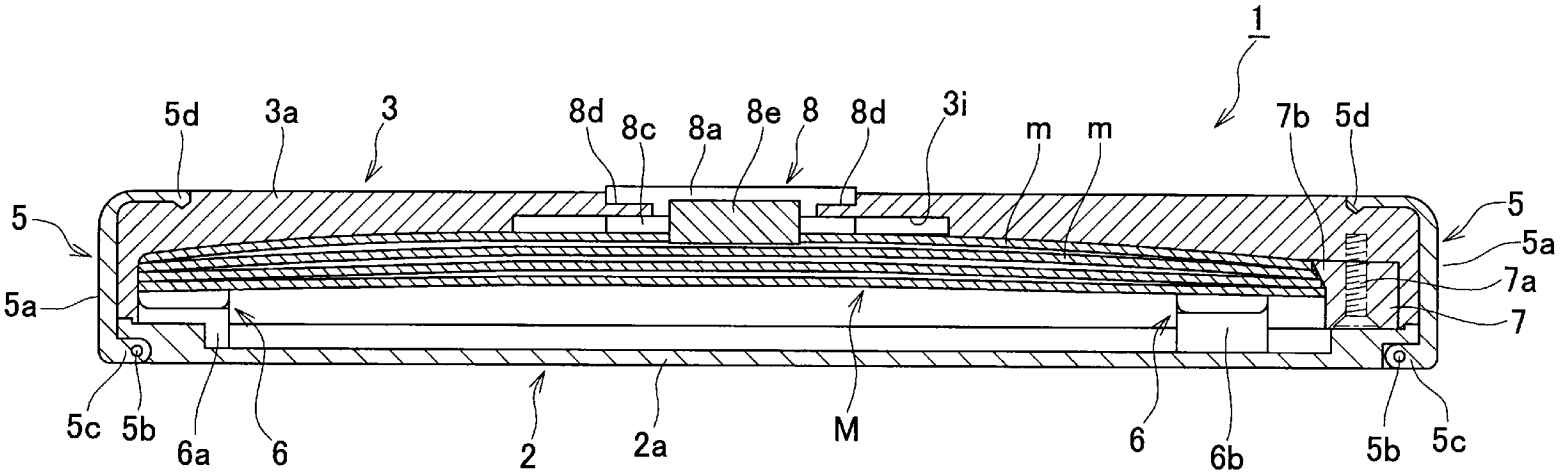
FIG. 6 is a sectional view in line A-A of FIG. 1 of a card case in accordance with the present invention.
Figure 7A:
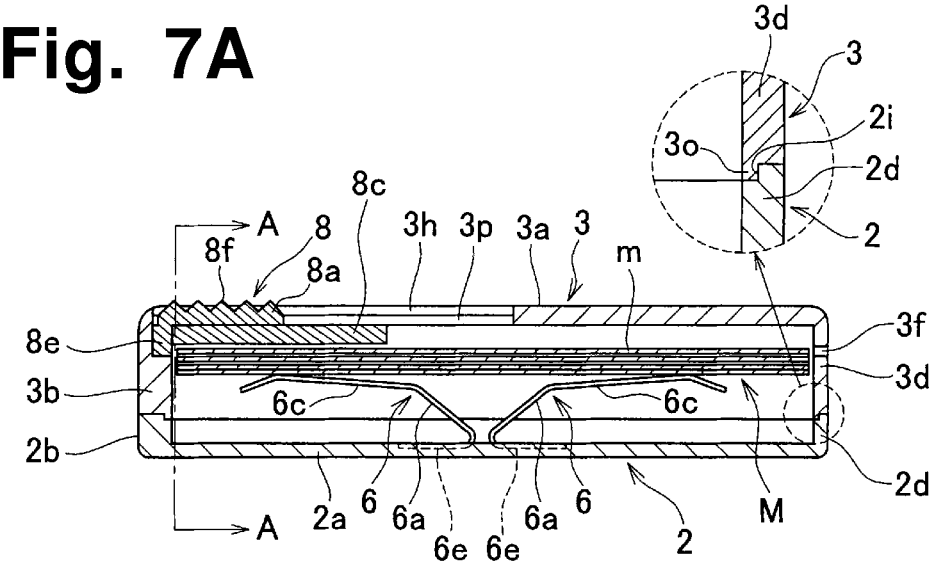
FIG. 7A is an illustrative view of an operation of a discharging button member of a business card case, FIG. 7A showing a state before the discharging operation of a card, and FIG. 7B showing a state of at the end of the discharging operation of a card.
Figure 7B:
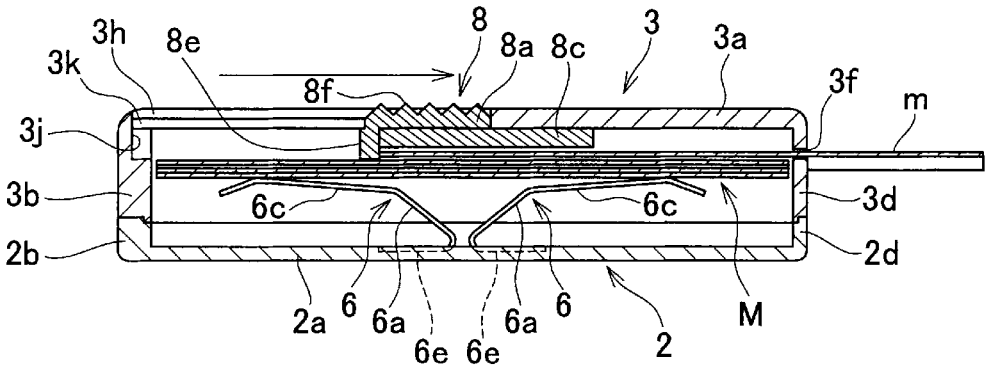

As shown particularly in FIGS. 5 and 6, the lower case 2 and the upper case 3 are both molded products which are manufactured by molding, preferably using synthetic resin material. The lower case 2 comprises a bottom plate 2*a* and peripheral walls 2*b*, 2*c*, 2*d*, 2*e* provided around the bottom plate 2*a*. The upper case 3 comprises a top plate 3*a* and peripheral walls 3*b*, 3*c*, 3*d*, 3*e* provided by surrounding the top plate 3*a*. The discharging opening 3*f* of a card is provided on the peripheral wall 3*d* of the peripheral walls 3*b*, 3*c*, 3*d*, 3*e* located in front-back direction. A recess 3*j* for receiving a locking portion 8*e* of the discharging button member 8 as described below is provided inside the peripheral wall 3*b* opposite to the peripheral wall 3*d* including the discharging opening 3*f*.

Figure 9:
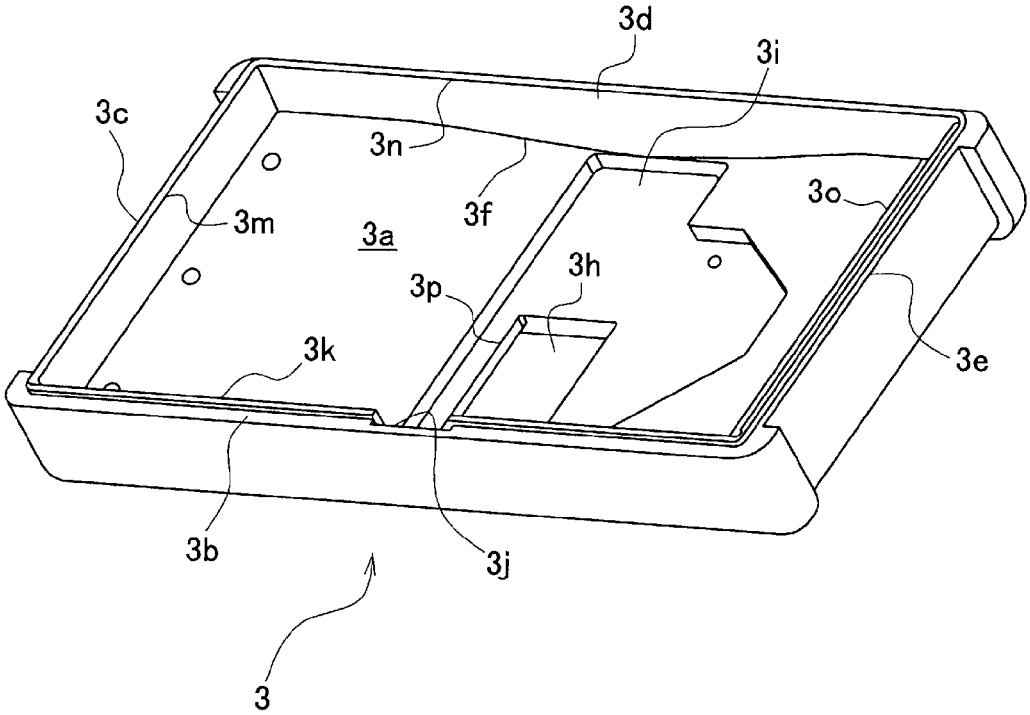
FIG. 9 is a perspective view of an upper case of a card case in accordance with the present invention, as shown from a back side.

Locking recesses 3*g*, 3*g* of the fixing means 5 are provided on upper portions at both ends of the top plate 3*a* of the upper case 3 in right and left direction. A window portion 3*h* is also provided substantially on a center of the top plate 3*a*. An accommodating recess 3*i* around the window portion 3*h* for accommodating a helical spring 9*a* as described below is provided in a back side of the top plate 3*a*, in particular as shown in FIG. 9. Furthermore, fitting protrusions 3*k*, 3*m*, 3*n*, 3*o* are provided on inner edges of the peripheral walls 3*b*, 3*c*, 3*d*, 3*e* of the upper case 3. On the other hand, fitting recesses 2*f*, 2*g*, 2*h*, 2*i* for receiving the fitting protrusions 3*k*, 3*m*, 3*n*, 3*o* of the peripheral walls 3*b*, 3*c*, 3*d*, 3*e* are provided on inner edges of peripheral walls 2*b*, 2*c*, 2*d*, 2*e* of the lower case 2.

Figure 4:
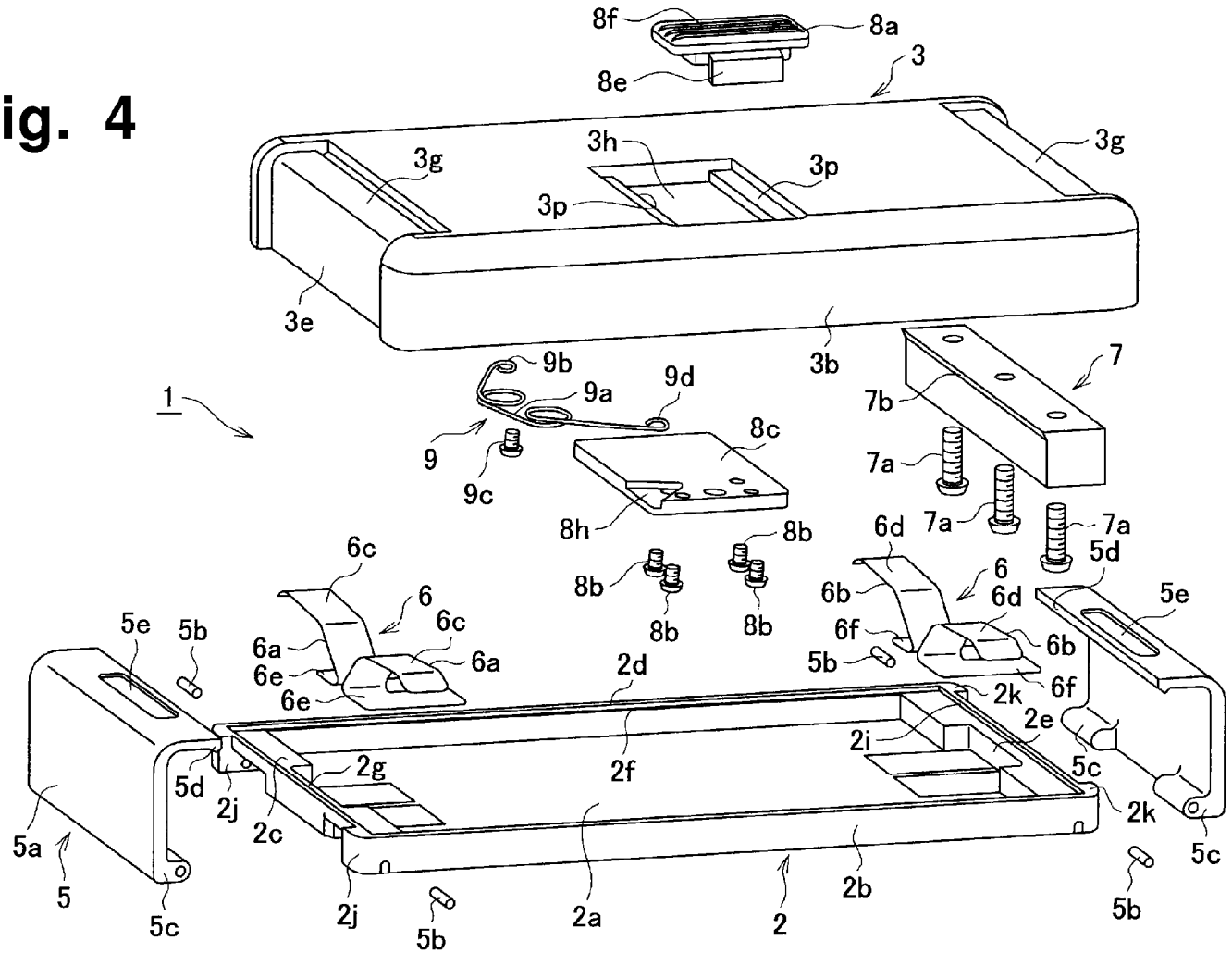
FIG. 4 is an exploded perspective view of a card case in accordance with the present invention.

The fixing means 5 are composed of fixing members 5*a*, 5*a*, with lateral sides being substantially C-shaped, in particular as shown in FIGS. 4 to 6 wherein attaching portions 5*c*, 5*c* of the fixing members 5*a*, 5*a* are openably/closably mounted via supporting pins 5*b*, 5*b* and 5*b*, 5*b* between pairs of attaching portions 2*j*, 2*j* and 2*k*, 2*k* provided respectively on both side portions of the lower case 2. The fixing means 5*a*, 5*a* are provided with locking protruding members 5*d*, 5*d* toward upper portions.

The lifting means 6 comprises elastic means composed of respective pairs of leaf springs 6*a*, 6*a* and 6*b*, 6*b* of which attaching members 6*e*, 6*e* and 6*f*, 6*f* are fixed at positions in right-left direction on the bottom plate 2*a* of the lower case 2, with their pressure contact portions 6*c*, 6*c* and 6*d*, 6*d* being headed in front-back direction. In the meantime, the leaf springs could be replaced with compression coil springs with pressing plates.

The guiding member 7 is in the shape of a square-bar with cross section in a rectangular shape, as attached via attaching screws 7*a*, 7*a*, 7*a* to inner surface of one side of the upper case 3, in particular as shown in FIGS. 4 and 5. A guiding portion 7*b* bent toward the inside is provided on the upper end side of the guiding member 7.

The discharging button member 8 comprises a button portion 8*a* on which a surface notch 8*f* is provided, a guiding plate 8*c* attached via attaching screws 8*b* to the button portion 8*a* with a predetermined interval being secured, and a locking portion 8*e*, in particular as shown in FIGS. 4 and 6. Guiding grooves 8*d*, 8*d* are formed on the button portion 8*a*. The discharging button member 8 is engaged with railing parts 3*p*, 3*p* provided on the window portion 3*h* of the upper case 3.

Figure 8:
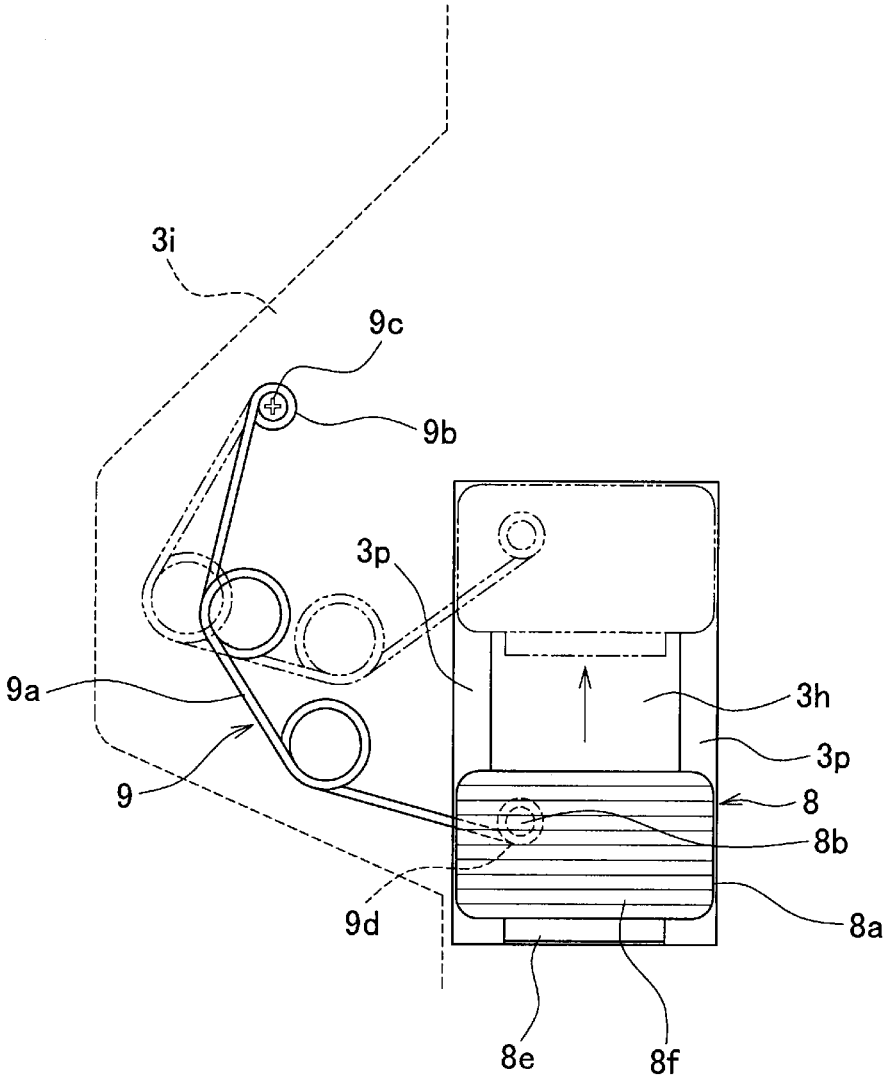
FIG. 8 is an illustrative view of an automatic returning means of a discharging button member of a business card case in accordance with the present invention.

The automatic returning means 9 of the discharging button member 8 comprises a helical spring 9*a* in particular as shown in FIG. 8. One end 9*b* of the helical spring 9*a* is pivotably engaged via a supporting pin 9*c* with the accommodating recess 3*i*, while its other end 9*d* is inserted into a notch 8*h* provided on the guiding plate 8*c* and rotatably engaged with one of attaching screws 8*b*. Here, a helical spring 9*a* of the automatic returning means 9 could be replaced with other elastic means such as a coil spring, an extension coil spring, a compression coil spring, a leaf spring, etc; on the other hand, if a helical spring 9*a* is used, it is possible to lay out the storage case 4 as thin as possible. Moreover, in case of use of a helical spring, the one made of a flat wire enables to further reduce the thickness of the storage case 4.

Functional effects of the card case of the present invention are described hereinafter.

Figure 10:
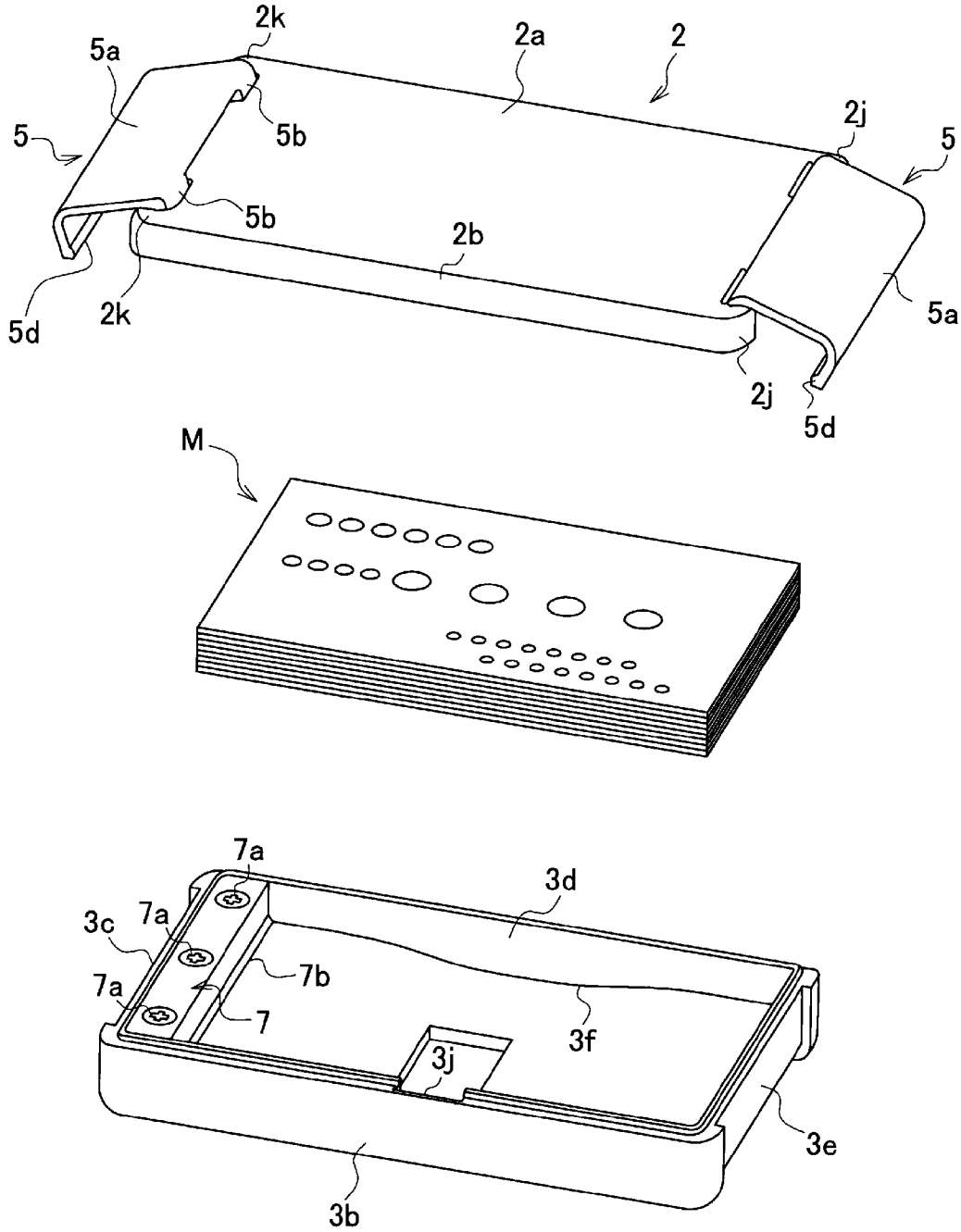
FIG. 10 is an illustrative perspective view of a procedure for storing a card into a storage case of a card case in accordance with the present invention.

First, as shown in FIG. 10, the lower case 2 is detached from the upper case 3 by inserting a finger into fingerholds 5*e*, 5*e* (see FIGS. 1 to 5) of the fixing members 5*a*, 5*a* and opening the fixing members 5*a*, 5*a* outwardly. Then the upper case 3 is put down in an inverted state, and a plurality of cards M (a stack of 7 to 10 cards for example being aligned) are stored therein. Next, the lower case 2 is put over the upper case 3 and each of the fitting protrusions 3*k*, 3*m*, 3*n*, 3*o* is fitted with a corresponding one of the fitting recesses 2*f*, 2*g*, 2*h*, 2*i*. Here, when the fixing members 5*a*, 5*a* of the fixing means 5 is rotated and the locking protruding portions 5*d*, 5*d* of the fixing members 5*a*, 5*a* are engaged with the locking recesses 3*g*, 3*g* of the upper case 3 while the upper case 3 and lower case 2 are held by hand, the lower case 2 and the upper case 3 are fixed with both the cases overlapping each other, and a plurality of cards M enter into the storage case 4. In the storage case 4, a plurality of cards M are lifted upward in the interior of the upper case 3 (toward a bottom surface of the top plate 3*a*) by the lifting means 6. Thereby, some of a plurality of cards M at the top are guided by the guiding portion 7*b* of the guiding member 7 so that they are bent and curved, in particular as shown in FIG. 6. As per the curvature, the card at the top is bent most, due to an angle of gradient of the guiding member 7*b*. Accordingly, the curvature is larger while approaching to the card m at the top, thus a gap is created between respective cards m, m, m . . . at the top, as shown in FIG. 6. In the meantime, a cross section of the guiding portion 7*b* can be curved.

On the other hand, as the discharging button member 8 is forced by the automatic returning means 9 to permanently remain available for use in a predetermined position, so that the locking portion 8*e* thereof is engaged with the most bended portion of a card m at the top.

In this state, a plurality of cards M are stored in the storage case 4. When the respective cards m are necessary, the discharging button member 8 is pushed toward the discharging opening 3*f*. Then, the card m at the top of the respective cards m stored in the storage case 4 is locked by the locking portion 8*e* of the discharging button member 8, and the card m at the top is slid together with the discharging button member 8 and pushed out of the storage case 4 through the discharging opening 3*f*.

When the card m is discharged from the discharging opening 3*f* and the grip on the discharging button member 8 is released, the discharging button member 8 is automatically pushed back by elastic force of the helical spring 9*a* of the automatic returning means 9 and goes back to an initial position. Once the discharging button member 8 returns to an initial position, a second card m is now bent the most so as to be available for use.

In the meantime, with innovations in a structure and an arrangement of elastic means, the automatic returning means 9 of the discharging button member 8 can be so designed that both the discharging operation of a card and the returning operation of the discharging button member 8 after discharging a card can be conducted semi-automatically.

When the second card m and the lower ones are necessary, the cards pushed out from the discharging opening 3*f* can be taken out in fingers by operating the discharging button member 8 in an above-mentioned manner until no card m is stored in the storage case 4.

In this case, the respective cards m could be securely locked by the locking portion 8*e* of the discharging button member 8, even when lifting force of the lifting means 6 is reduced, since a card bent by the guiding member 7 is not pressed from a top side while discharged.

Embodiment 2

Figure 11:
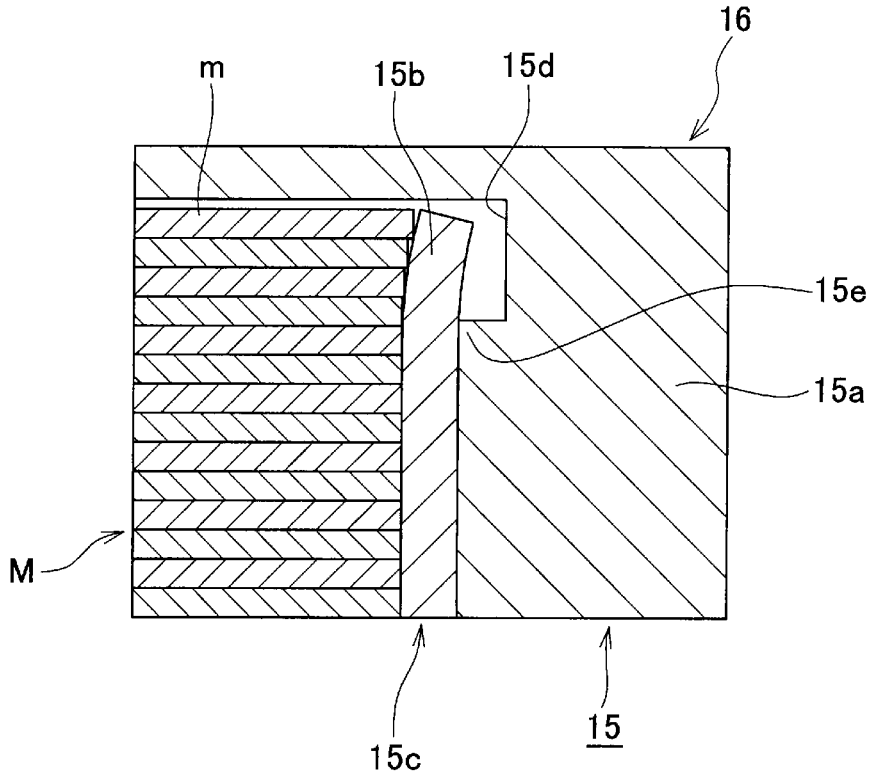
FIG. 11 is an illustrative sectional view of a second embodiment of a guiding means of a card case in accordance with the present invention.

FIG. 11 shows other embodiment of a card case according to the present invention. In the card case of embodiment 2, a substrate portion 15*a* is provided inside an upper case 16. A guide body 15*c* made of elastic flexible material such as gum attached to an inner surface of the substrate portion 15*a* is fixed to the substrate portion 15*a*. In the substrate portion 15*a*, a releasing recess 15*d* is so provided that a bending portion 15*b* of an upper side of the guide body 15*c* can be bent and released. In this manner, the guide body 15*c* presses respective cards positioned lower than a bending fulcrum 15*e* with the same pressure; however, the bending portion 15*b* above the bending fulcrum 15*e* is so designed that the pressure pressing the cards decreases toward the top.

More specifically an elastic guide body 15*c* is attached to the inner surface of the substrate portion 15*a* of the upper case 16, for example by means of bonding. In an inner portion at the top of the substrate portion 15*a* the releasing recess 15*d* for releasing the bending portion 15*b* of the guide body 15*c* is provided. In the embodiment as above described, a pressure of the elastic bending portion 15*b* against the sides of the respective cards m of a plurality of stacked cards M is reduced when they lie remote from the bending fulcrum 15*e*, so that the card at the top shows a smallest resistance against the discharging operation. Therefore, an advantage of facilitating the discharging operation of the card at the top only can be obtained.

The present invention implemented as described in the foregoing enables to securely discharge the card taken out from a storage case to the last one. And also, since a returning operation of a discharging button member is automatically conducted, the present invention can be favorably used as a user-friendly business card case.

What is claimed is:

1. A business card case comprising:

a storage case with a discharging opening for discharging a card, which stores a plurality of cards in its interior, and comprises a lower case and an upper case vertically detachable from each other;

fixing means fixing the lower case and the upper case while both the cases overlap each other;

lifting means provided on the lower case, which lifts up the plurality of cards stored in the lower case toward the upper case;

a guiding member provided on one side of the storage case, which bends at least the ones at the top end of the plurality of cards stored in the lower case;

a discharging button member slidably provided toward the discharging opening on the upper case, which comprises a locking portion for locking the ones at the top end of the plurality of cards; and an automatic returning means automatically returning the discharging button member from a predetermined sliding position to an initial position;

wherein the guiding member comprises a substrate portion provided on one inside the upper case and an elastic guide body provided inside the substrate portion; and wherein a releasing recess is provided inside the substrate portion, on an upper side of the guide body.

2. The business card case according to the claim 1, wherein the fixing means comprise fixing members openably/closably attached to both sides of the lower case, and wherein a locking protruding member provided on a free side of the fixing members is engaged with the upper case so that the lower case and the upper case are fixed while both the cases overlap each other.

3. The business card case according to the claim 1, wherein the lifting means further comprises elastic means, the elastic means being leaf springs provided on an inner bottom of the lower case.

4. The business card case according to the claim 1, wherein the automatic returning means comprises a helical spring rotatably engaged with an inner side of the top plate of the upper case at a first end portion thereof, and wherein a second end portion is rotatably engaged with a guide plate provided on the discharging button member.

5. The business card case according to the claim 1, further comprising a guiding member mounted on an inside of one side of the storage case in contacted with business card, the guiding member having a guiding portion provided on an upper inside end thereof, the guiding portion inclined or curved toward the inside, thereby those of the upper end of the business card that has been pushed up by push-up means are bent by the guide portion.

* * * * *